US007840492B2

(12) United States Patent
Leung et al.

(10) Patent No.: US 7,840,492 B2
(45) Date of Patent: Nov. 23, 2010

(54) PERSONAL FUNDS METERING SYSTEM AND METHOD

(75) Inventors: Alan Leung, New York, NY (US); John W. Rojas, Norwalk, CT (US); James R. Norris, Jr., Danbury, CT (US); Jean-Hiram Coffy, Norwalk, CT (US); Arthur Parkos, Southbury, CT (US); John F. Braun, Fairfield, CT (US); Wendy Chui Fen Leung, Woodside, NY (US)

(73) Assignee: Pitney Bowes Inc., Stamford, CT (US)

( * ) Notice: Subject to any disclaimer, the term of this patent is extended or adjusted under 35 U.S.C. 154(b) by 2455 days.

(21) Appl. No.: 10/248,249

(22) Filed: Dec. 30, 2002

(65) Prior Publication Data

US 2004/0128264 A1 Jul. 1, 2004

(51) Int. Cl.
*G07B 17/02* (2006.01)
*G07B 17/04* (2006.01)

(52) U.S. Cl. ..... 705/62; 705/401; 705/403; 705/408; 705/409; 705/410

(58) Field of Classification Search ..... 382/124; 705/23, 60–62, 401, 403, 408–410; 235/462.01, 235/462.04, 462.09
See application file for complete search history.

(56) References Cited

U.S. PATENT DOCUMENTS 4,148,430 A * 4/1979 Drake ..... 229/69
4,190,162 A * 2/1980 Buescher ..... 229/314
4,688,026 A * 8/1987 Scribner et al. ..... 235/385
4,759,283 A * 7/1988 Gilham et al. ..... 101/91
4,780,828 A 10/1988 Whisker et al.
5,001,648 A * 3/1991 Baker ..... 705/407
5,382,784 A * 1/1995 Eberhardt ..... 235/462.46
5,453,762 A 9/1995 Ito et al. ..... 345/179
5,495,250 A * 2/1996 Ghaem et al. ..... 342/51
5,497,140 A * 3/1996 Tuttle ..... 340/10.1
5,502,304 A * 3/1996 Berson et al. ..... 250/271
5,554,842 A * 9/1996 Connell et al. ..... 235/491
5,574,790 A 11/1996 Liang et al.

(Continued)

FOREIGN PATENT DOCUMENTS

EP 0710930 A 5/1996

(Continued)

OTHER PUBLICATIONS

Postal Bulletin 22007, Sep. 23, 1999. Published by the United States Postal Service.*

(Continued)

*Primary Examiner*—Andrew J. Fischer
*Assistant Examiner*—Christopher C Johns
(74) *Attorney, Agent, or Firm*—George M. Macdonald; Angelo N. Chaclas

(57) ABSTRACT

Methods and systems for dispensing value are described. In one configuration, a unique tangible indicia is enabled with a value and then disabled after the value is redeemed. In another configuration, a user enables a unique coded stamp and associates a postage payment with the stamp. The postal service cancels the stamp by deactivating the stamp from a list of active stamps and optionally audits the payment association.

13 Claims, 3 Drawing Sheets

U.S. PATENT DOCUMENTS 5,595,356 A * 1/1997 Kewin ..... 242/613.5
5,612,720 A 3/1997 Ito et al. ..... 345/179
5,640,002 A * 6/1997 Ruppert et al. ..... 235/462.46
5,684,705 A * 11/1997 Herbert ..... 705/401
5,717,597 A * 2/1998 Kara ..... 705/408
5,779,137 A * 7/1998 Coffey ..... 358/1.9
5,838,253 A * 11/1998 Wurz et al. ..... 340/10.42
5,843,620 A * 12/1998 Masuda et al. ..... 430/258
5,943,432 A * 8/1999 Gilmore et al. ..... 382/101
6,013,949 A * 1/2000 Tuttle ..... 257/723
6,025,780 A * 2/2000 Bowers et al. ..... 340/572.3
6,130,613 A * 10/2000 Eberhardt et al. ..... 340/572.7
6,206,292 B1 * 3/2001 Robertz et al. ..... 235/488
6,208,771 B1 3/2001 Jared et al. ..... 382/306
6,232,876 B1 * 5/2001 Maloney ..... 340/568.1
6,286,763 B1 * 9/2001 Reynolds et al. ..... 235/472.01
6,310,988 B1 10/2001 Flores et al. ..... 382/313
6,311,042 B1 10/2001 DeSchrijver ..... 455/66
6,327,395 B1 12/2001 Hecht et al. ..... 382/306
6,357,662 B1 * 3/2002 Helton et al. ..... 235/462.45
6,366,205 B1 * 4/2002 Sutphen ..... 340/568.6
6,371,375 B1 * 4/2002 Ackley et al. ..... 235/462.45
6,386,591 B1 * 5/2002 Blank ..... 283/75
6,396,598 B1 5/2002 Kashiwagi et al. ..... 358/474
6,415,536 B1 * 7/2002 Nobrega, Jr. ..... 40/625
6,415,978 B1 * 7/2002 McAllister ..... 235/462.01
6,427,021 B1 * 7/2002 Fischer et al. ..... 382/101
6,502,756 B1 * 1/2003 Fåhraeus ..... 235/494
6,526,393 B1 * 2/2003 Fredman ..... 705/408
6,548,768 B1 4/2003 Pettersson et al. ..... 178/18.01
6,557,758 B1 * 5/2003 Monico ..... 235/380
6,570,104 B1 5/2003 Ericson et al. ..... 178/18.09
6,573,887 B1 6/2003 O'Donnell, Jr. ..... 345/179
6,577,300 B2 6/2003 Picoult et al. ..... 345/179
6,586,688 B2 7/2003 Wiebe ..... 178/18.09
6,594,406 B1 7/2003 Hecht ..... 382/306
6,609,653 B1 8/2003 Lapstun et al. ..... 235/375
6,617,962 B1 * 9/2003 Horwitz et al. ..... 340/10.4
6,621,417 B2 * 9/2003 Duncan et al. ..... 340/572.1
6,627,870 B1 9/2003 Lapstun et al. ..... 250/221
6,681,045 B1 1/2004 Lapstun et al. ..... 382/187
6,753,830 B2 * 6/2004 Gelbman ..... 345/55
6,758,403 B1 * 7/2004 Keys et al. ..... 235/462.45
6,763,996 B2 * 7/2004 Rakers et al. ..... 235/375
6,817,517 B2 * 11/2004 Gunther ..... 235/375
6,865,558 B1 * 3/2005 Pierce et al. ..... 705/60
6,925,471 B2 * 8/2005 Bodin et al. ..... 707/103 R
7,058,614 B1 * 6/2006 Wesseling et al. ..... 705/408
7,103,583 B1 * 9/2006 Baum et al. ..... 705/409
7,149,726 B1 * 12/2006 Lingle et al. ..... 705/411
7,233,929 B1 * 6/2007 Lingle et al. ..... 705/402
7,240,037 B1 * 7/2007 Bussell ..... 705/75
7,277,866 B1 * 10/2007 Or-Bach et al. ..... 705/28
7,299,210 B2 * 11/2007 Weisberg et al. ..... 705/62
7,302,414 B2 * 11/2007 Cox ..... 705/401
7,567,940 B1 * 7/2009 Engelberg et al. ..... 705/62
7,613,639 B1 * 11/2009 Ogg ..... 705/35
2001/0032190 A1 * 10/2001 Ediger et al. ..... 705/62
2001/0055411 A1 12/2001 Black ..... 382/124
2002/0035687 A1 3/2002 Skantze ..... 713/168
2002/0057824 A1 5/2002 Andreasson ..... 382/101
2002/0073039 A1 6/2002 Ogg et al.
2002/0073040 A1 * 6/2002 Schwartz et al. ..... 705/62
2002/0107885 A1 8/2002 Brooks et al. ..... 707/505
2002/0126105 A1 9/2002 O'Donnell, Jr. ..... 345/179
2002/0193975 A1 12/2002 Zimmerman ..... 703/6
2003/0001020 A1 1/2003 Kardach ..... 235/494
2003/0046256 A1 3/2003 Hugosson et al. ..... 707/1
2003/0133629 A1 7/2003 Sayers ..... 382/313
2004/0108386 A1 * 6/2004 Rasti ..... 235/494

FOREIGN PATENT DOCUMENTS

JP 2001-43000 A 2/2001
WO 02/11073 A 2/2002

OTHER PUBLICATIONS

Postal Bulletin 21971, May 7, 1998. Published by the United States Postal Service.*
Postal Bulletin 21995, Apr. 8, 1999. Published by the United States Postal Service.*
Postal Bulletin 22054, Jul. 12, 2001. Published by the United States Postal Service.*
"Authentication." Dictionary of Personal Computing and the Internet, Peter Collin Publishing. 2000. CredoReference. Jul. 18, 2007 <http://www.credoreference.com/entry/1064752>.*
Postal Bulletin 21971, United States Postal Service. May 7, 1998.*
Reuse. (2000). In The Penguin English Dictionary. London: Penguin. Retrieved Oct. 10, 2008, from http://www.credoreference.com/entry/1168433/.*
'vault'. (2007). In The American Heritage® Dictionary of the English Language. Boston, MA: Houghton Mifflin. Retrieved Apr. 1, 2009, from http://www.credoreference.com/entry/7140194/.*
SET Secure Electronic Transaction Specification, Book 1: Business Description, Version 1.0. May 31, 1997. MasterCard/Visa publication. pp. i-v, 1-5, 12, 13, and 55-72 included; entire book cited.*
"Cross Unveils the Cross :Convergence Wireless Scanner Pen", PC Business Products, Feb. 1, 2001. Product announcement.*
Anoto Advertising Booklet—"Uniting Handwriting with the Digital World", undated, 15 pages.
Anoto Advertising Booklet—"Hey, Guess What Those Nifty Swedes Have Dreamed Up Now to Revolutionize Digital Communiction?!", undated, 22 pages.
"A Comparison of Anoto Technology with Other Releeant Systems." Undated. 17 pages.
Anoto Functionality—World Wide Web pages from www.anotofunctionality.com. Accessed Jan. 29, 2004. 7 pages.
Unknown Anoto, Subsidiary of C Technologies, Initiates Collaboration with John Dickinson, UK's Leading Producer of Stationary Products, Apr. 23, 2001, Business Wire, 2 pages.

* cited by examiner

PERSONAL FUNDS METERING SYSTEM AND METHOD

BACKGROUND OF INVENTION

The illustrative embodiments described in the present application are useful in systems including those for dispensing value and more particularly are useful in systems including those for providing evidence of payment of postage that can be traced to a sender.

The United States Postal Service (USPS) provides a service of mailpiece reception, sorting and delivery to national addresses and international postal streams. The USPS processes approximately 200 billion domestic letters per year. The USPS also processes parcels. Similarly, other courier services provide services for delivery of letters and parcels.

In 2001, Anthrax spores were found on mail pieces, mail-handling equipment and in or near areas where certain mail pieces that likely contained anthrax spores were handled. Postal service customers generally pay for postage by either buying a stamp or by using a postage meter to print indicia used to evidence payment of postage. Previously, the identity of a sender using stamps was never truly known and the identity of the sender of a mail piece could not generally be traced. Mailing machines including postage meters are commercially available from Pitney Bowes Inc. of Stamford, Conn.

Furthermore, postage payment evidencing systems are subject to fraud attacks. Previously, payment authentication by the post office was too costly to implement. As a result, the postage payment process is subject to fraud attacks and mailpieces are not generally traceable to an origin. Unscrupulous attackers may duplicate stamps.

SUMMARY OF INVENTION

The present application describes several illustrative embodiments of systems and methods for dispensing value, some of which are summarized here for illustrative purposes. In one illustrative embodiment, a unique tangible indicia is enabled with a value and then disabled when the value is used. In another illustrative embodiment, a user enables a unique coded stamp and associates a postage payment with the stamp. The postal service cancels the stamp by deactivating it from a list of active stamps and optionally audits the payment association. In a further embodiment, trace-ability information is associated with the postage payment transaction including routing information.

DETAILED DESCRIPTION

Figure 1:
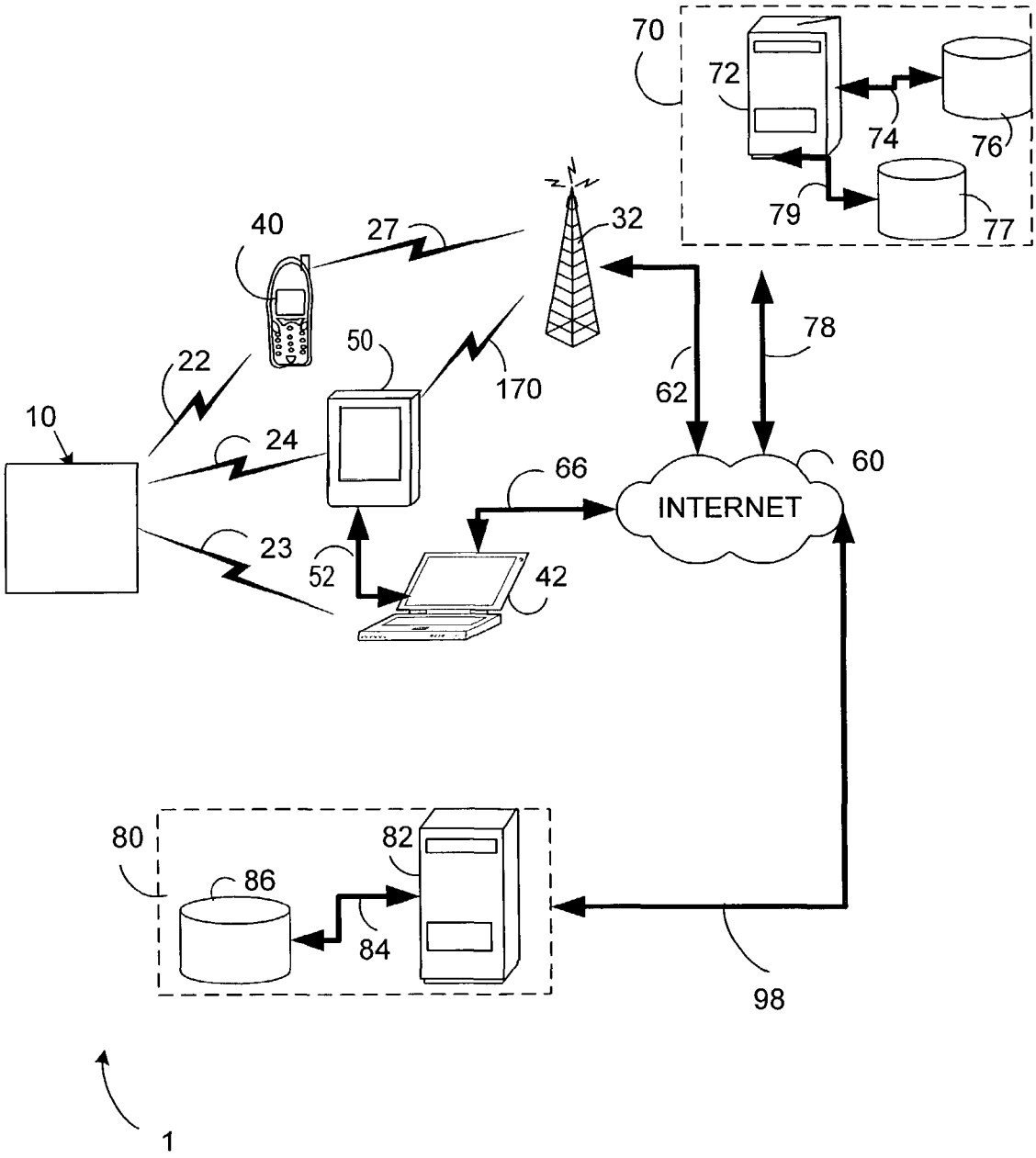
FIG. 1 is a schematic representation of a value dispensing system according to an illustrative embodiment of the present application.

Systems and methods for dispensing value are described according to illustrative embodiments of the present application.

Certain embodiments of the present application describe a process for enabling and disabling unique stamps that include uniquely identified indicia that are not reused over a period of time. The period of time may be three years. The indicia represent postage and may be used as a replacement for traditional stamps. The stamps may be reused after deactivation or reprinted by using the same number on new media provided that the original stamp media was taken out of circulation.

The process includes activating and deactivating a unique encoded identifier that would be used as a stamp. The unique ID is placed on an envelope or stamp and is deactivated by default. A user will then utilize a device to activate and pay for the stamp. The postal authority then receives the mailpiece having the stamp and would scan the stamp to determine if the sender had paid for the postage. If the user did pay for the postage, the postal authority would process the letter and deactivate the stamp.

Digital pen systems such as the Sony-Ericsson CHA-30 Chatpen utilize ANOTO brand paper available from Anoto AB of Sweden. The ANOTO brand paper includes a grid for encoding information such as position information that is detected by the Chatpen. Additionally, other scanners may be used to detect the pattern and decode the pattern to obtain an identifier. A Chatpen or other scanning device such as a scanning enabled PDA available from Symbol Technologies of New York may be used to authenticate a user and process stamps.

Commonly owned, Co-pending U.S. patent application Ser. No. 10/065,261, entitled Method And System For Creating And Sending A Facsimile Using A Digital Pen, filed on Sep. 30, 2002, is incorporated herein by reference in its entirety.

Commonly owned, co-pending U.S. patent application Ser. No. 10/065,282, entitled Method And System For Creating a Document Having Metadata, filed on Sep. 30, 2002, is incorporated herein by reference in its entirety.

Commonly owned, Co-pending U.S. patent application Ser. No. 10/065,261, entitled Systems and Methods Using a Digital Pen for Funds Accounting Devices and Postage Meters, filed on Oct. 4, 2002, is incorporated herein by reference in its entirety.

Commonly owned, Co-pending U.S. patent application Ser. No. 10/248,248, entitled System and Method For Authenticating a Mailpiece Sender, filed on Dec. 30, 2002, is incorporated herein by reference in its entirety.

The illustrative embodiments described herein provide for methods and apparatus for activating and deactivating a stamp. However, other value dispensing systems may be configured according to the embodiments herein. The processes and apparatus described may be implemented using hardware, software or a combination of both. The communications channels may be wireless or wired and may utilize security techniques such as encryption and authentication. The data storage and data processors may be locally or remotely located and may utilize techniques such as load balancing and redundancy.

Referring to FIG. 1, a first illustrative embodiment describing a value dispensing system 1 is shown. An indicia 10 includes an ANOTO brand pattern that encodes an identifier. The identifier is preferably unique in that it is not used on another media within three years unless the current media is retired. However, in an alternative, the pattern is reused in other unrelated fields. The indicia 10 may be reusable such as a tollbooth token in that it may be a reusable stamp.

System 1 includes an ANOTO pattern lookup server 80 that includes storage 86 connected by connection 84 to processor 82. The server 80 is connected to Internet 60 using connection 98.

The system 1 includes at least one scanning device such as Scanning PDA 50 that is a scanning enabled PDA available from Symbol Technologies. The PDA 50 includes wireless access 170 to the Internet 60 through a wireless service 32. The PDA 50 may be connected to the Laptop 42 using a wired or wireless connection 52. The Laptop 42 is connected to the Internet 60 using a wireless or wired connection 66 and may provide a gateway. The Laptop 42 can scan indicia 10 using scan channel 23. The PDA 50 can scan the indicia 10 using scan channel 24. Alternatively, a cellular telephone 40 may include a wireless connection 27 to the wireless cellular service provider 32. The service provider 32 is connected to the Internet 60 by connection 62. The phone 40 may include scanning capability 22. MAC or other unique identification codes may be used to identify any of the processors described herein. Furthermore, a user may be authenticated using biometric information such as a retinal scan, voiceprint or fingerprint.

Value receiving server 70 is described for illustrative purposes as a postal service server system. However, any value receiving service may use the embodiments of the present application. Postal Authority Server 70 includes a server processor 72, storage for user accounts 76 connected by channel 74 and stamp data 77 connected by channel 79. The server 70 is connected to the Internet 60 using channel 78.

Other well-known input devices, servers, processors, networks and communications mechanisms may be used. A back-end application may be utilized to process the user authentication and value dispensing accounting functions. It is contemplated that all of the connections utilize appropriate security measures including encryption and authentication.

Laptop 42 utilizes a mobile Pentium 4 processor and Windows XP. The server processors are geographically and load balanced application servers using systems available from Sun Microsystems. The storage servers use multiple location redundant backup systems. Additionally, other appropriate wireless and wired networks and other connections may be utilized. It is contemplated that other communications channels such as OC-3 lines or wireless connections could be used. Various communication flows may be utilized, some of which will be chattier than others. Laptop 42 could also provide gateway access to the TCP/IP Internet network.

The value dispensing system 1 may utilize a local value vault or a distributed vault account. For example, the PDA 50 may contain a postage vault for storing and accounting for postage. Alternatively, an account having postage may be maintained that is accessible to the user and the postal authority server 70.

In one embodiment, a disabled stamp has a set value such as the 1 oz. First class rate that may be $0.37. When the user scans the stamp, the local processor (such as PDA 50) requests authorization. The local processor may debit a local vault or may request authorization and a debit from a remote postal vault. The stamp is then activated and may be used.

In another embodiment of a postage metering system, a user with access to a metering device (such as PDA 50) would buy an envelope or stamp that represents a unique identifier. The user would then scan the stamp and the initial value of the stamp would be set to 37 cents or any minimal value that the stamp can be worth. The metering device 50 logs on to a central billing server 70 that authenticates the user and enables the stamp on the server side. The user would then place the letter into the mail stream.

When the letter reaches the post office, the mail would be sorted and scanned. During the sort process, if a package were under paid, the postal authority would automatically charge the extra amount to the stamp user by using the current weighing system at the postal service facility. In an alternative, dimensional or regular weighing processes may be used.

When the letter reaches the scanning process, the stamp 10 is scanned to determine if it is activated. If necessary, the system 70 bills the user. The mail system scanner then disables the stamp and the letter is processed. If the mailpiece has an inactive stamp, it may be returned to the sender or otherwise processed for the exception.

In one embodiment, a postage meter according to an embodiment of the present application includes a handheld device PDA 50 that is capable of scanning the unique stamp 10. Handheld 50 includes a device that can connect to the billing server 70 through Internet 60 using a cell phone, modem or other connection. In one embodiment, the stamp is encoded using two types of ink. The meter (such as PDA 50) requires a sensor such as a scanner and different light source for each ink used. The reflection from the light source should be discernable so that the correct sensor or camera detects the encoded information.

When a user registers a Postage Meter (such as PDA 50), the user provides information including billing information. The postage meter 50 is then enabled and works much like an ATM in which the user types in her password and requests the amount to charge from her account. The meter 50 uses an external postage value account, but an internal vault could be used. Other authentication techniques such as a retinal scan may be required instead or in addition the password entry. The meter 50 then sends the registration information or meter identifier with the unique stamp ID to the central billing server 70. The postage meter 50 does not require ink and does not print the indicia.

Figure 2A:
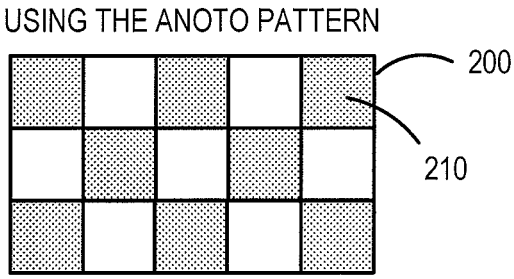
FIGS. 2A-2C are schematic diagrams of representative indicia according to an illustrative embodiment of the present application.
Figure 2B:
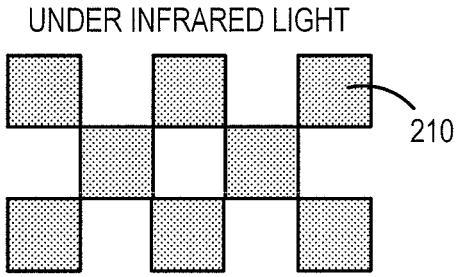
Figure 2C:
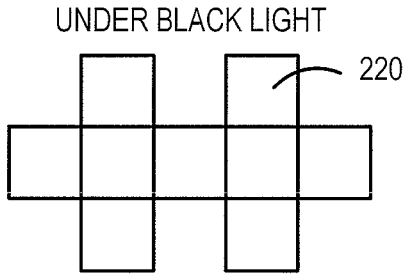

Referring to FIGS. 2A-2C, representative indicia are shown according to an illustrative embodiment of the present application. An ANOTO brand pattern is printed on stamp 200. In this alternative, two inks are used in the same space to increase the information density of the ANOTO brand pattern. In another alternative, one ink may be used, or more than two inks may be used. The ANOTO brand pattern is known to have a large area of uniquely defined space in a 2dimensional pattern space. Here, the stamp 200 is uniquely identified by the unique pattern within a 0.5-inch by 0.5-inch box 210. The stamp is encoded so that it cannot be easily copied. The stamp 200 enables a sufficient amount of unique combinations in order to satisfy the anticipated need for the stamps for at least three years. In an alternative, in order to increase the amount of unique stamps exponentially, the same encoded ID is printed over each other but slightly offset or out of phase with different types of ink.

In the multiple ink embodiments, each type of ink should react differently depending on the type of light that it is exposed to. Depending on the type of light that the Metering Scanning Device or Scanning Device shines on the stamp, the camera should detect a different subset of the ANOTO brand pattern 210, 220. The scanned patterns are used to decode a stamp identifier. The identifier may also be digitally signed by the stamp authority using a digital signature to ensure authenticity. Since the number of potential combinations of the ANOTO brand pattern in a 9 square millimeter box is very large, using two 2 overlapping square boxes each having a different ink drastically increases the number of combinations available. Similarly, additional different inks may be used to increase the information density. In an alternative, having the same two patterns alternate in repeating rows allows the stamp to be more flexible when being scanned. Other known redundancy schemes may be employed to enhance scanning efficiency and accuracy.

Figure 3A:
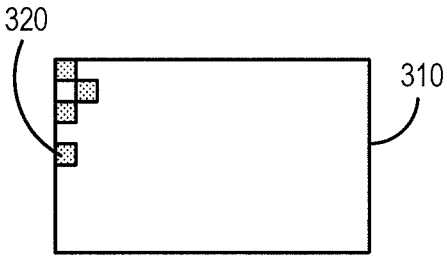
FIGS. 3A-3B are schematic diagrams of representative indicia according to another illustrative embodiment of the present application.
Figure 3B:
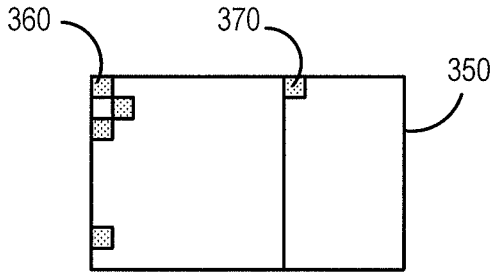

Referring to FIG. 3A and FIG. 3B, indicia are shown according to another illustrative embodiment of the present application. Referring to FIG. 3A, a 2D barcode 320 such as a PDF417 barcode is printed on a reusable stamp 310. Such a barcode typically stores 1.1 kilobytes of information and with redundancy could be used to store a 256 bit identification number that can provide a very large number of unique identifiers for the stamps.

Referring to FIG. 3B, a 2D barcode such as a PDF417 barcode 360 is printed on a reusable stamp 350 that has a portion of the stamp 370 used for a digital signature so that the stamp is authenticated. In an alternative, a different bar code may be used. In another alternative, the indicia can be printed on an envelope. In another embodiment, the indicia are printed on reusable envelopes or labels.

Figure 4A:
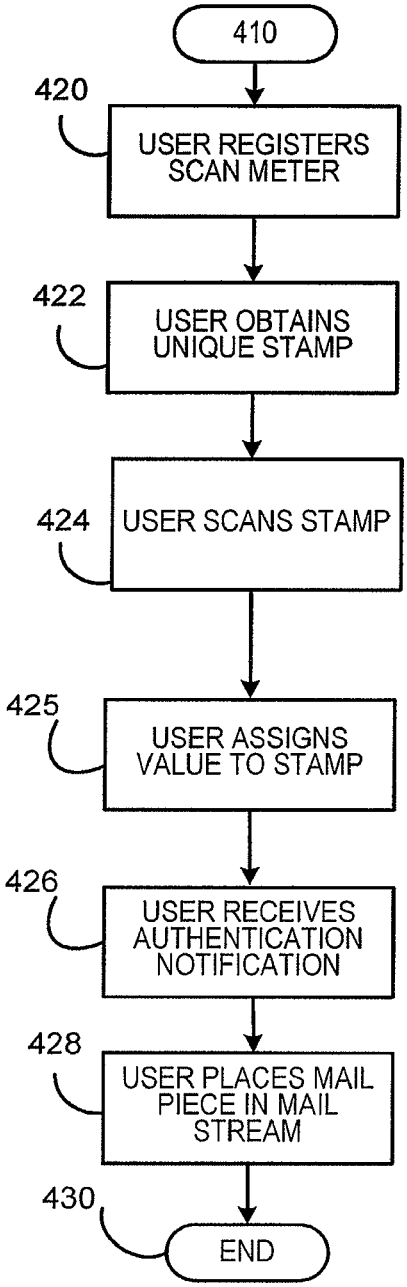
FIG. 4A is a flow chart showing a process for a user for enabling indicia according to an illustrative embodiment of the present application.

Referring to FIG. 4A, a process for enabling a stamp according to an illustrative embodiment of the present application is shown.

The process starts in step 410. In step 420, the user registers a meter that has access to an indicia scanner. In step 422, the user obtains a unique stamp. The user could print the unique stamp locally. In step 424, the user scans the stamp and decodes the identifier. In step 425, if the stamp does not already have a value assigned to it, the user assigns a value to the stamp and the user postage is debited from a local vault or a remote vault. In step 426, the user receives an indication that the stamp is activated. If the user does not have sufficient postage, the user may be prompted to add more postage. Otherwise, the stamp will not be activated. In step 428, the user places the mailpiece with the stamp into the mail stream and in step 430, the process ends.

In one embodiment, the postal service 70 uses scanning mechanisms that are able to detect the different type of inks that are used on the stamp. The postal server 72 provides a billing server to activate and deactivate the unique stamp IDs in its database. The server 72 also receives weighing information in order to determine whether extra postage charges are required.

In another embodiment, the system 1 includes a post office window meter. A user that does not have a postage meter 50 could go to the post office and prepay for the stamps that they buy. The user would be required to present valid Identification and the stamp 10 would be activated. The stamp then would include tightly coupled information regarding the purchaser. The stamp 10 in this alternative would have a static value unless the user provided a postage-underpayment billing alternative.

In yet another embodiment in which a user does have a registered Postage Meter 50, the user obtains a mail piece that has the unique stamp preprinted on the envelope. Alternatively, the stamp is an adhesive stamp that the user can stick to the envelope. Furthermore, the user could remove a stamp from her incoming mail in order to reuse the stamp. The user would then use her Postage meter to scan the stamp in order to pay for and activate it. Stamp information would then be sent to the central server 70. The server 70 would authenticate and activate the stamp on the server side.

In another embodiment, a process for sorting the mail with enabled stamps is shown after the letter is mailed and reaches the post office 70. The letter is weighed, scanned, and authenticated. Once the letter is authenticated and the user has been billed, the stamp is deactivated and the letter processed. In this embodiment, anyone who receives mail obtains deactivated stamps that they could reactivate with their Postage Meter 50.

In an alternative in which an exception or illegal behavior is detected, the stamp could be used to track the sender of the letter. If a user were to lose their Postage Meter 50, they could deactivate it or track it much like a missing cell phone. Anyone who scans a copy of a stamp with a stolen meter 50 would not be able to use the stamp because they would have to activate it in order for it to be authenticated.

Figure 4B:
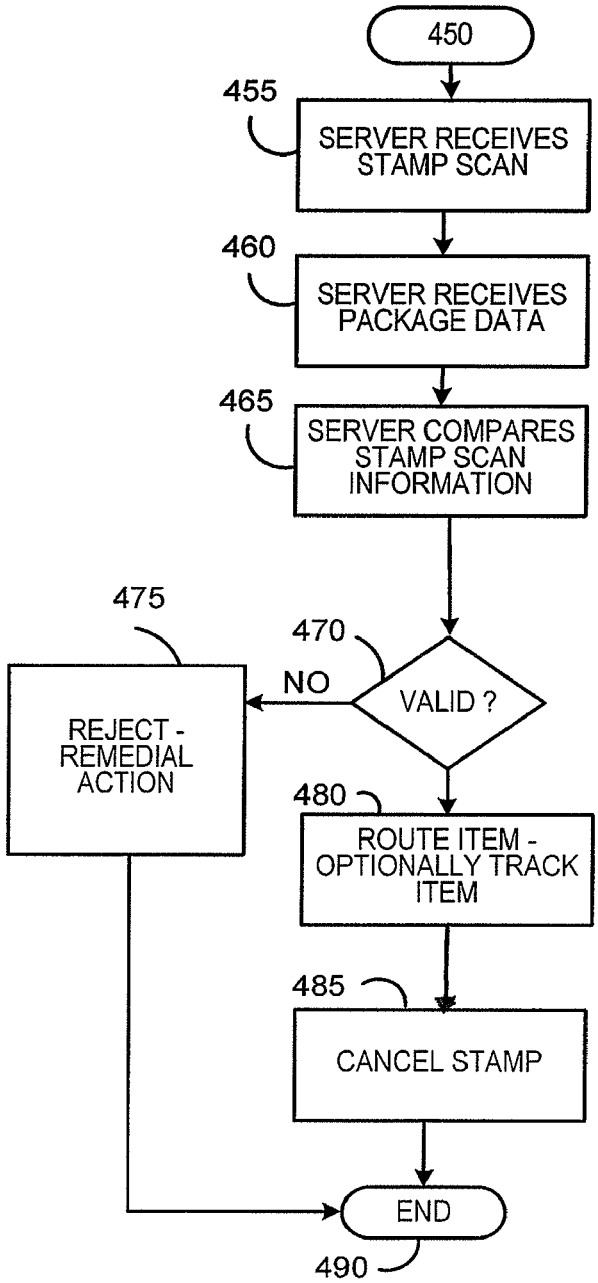
FIG. 4B is a flow chart showing a process for a carrier for accepting a mailpiece and canceling indicia according to an illustrative embodiment of the present application.

Referring to FIG. 4B, a process for receiving value is described according to an illustrative embodiment of the present application. A postage receiving system is described for illustrative purposes, but other value receiving systems may be configured according to the embodiments of the present application.

The process starts in step 450. In step 455, the postal service server 72 receives stamp scan information. In step 460, the server receives package data. In step 465, the server 72 compares the stamp scan information to determine if the stamp is valid. If the stamp is valid in step 470, the letter or package is routed in step 480. The system optionally tracks the item. In step 485, the stamp is canceled. The stamp may be destroyed and the number reused or the stamp can be sent back into circulation for reuse. If the stamp is not valid, in step 475, the letter is rejected and any remedial action taken. The process ends in step 490.

In an alternative, the USPS system 70 also provides the authentication services to the user and a private symmetric key could be used to ensure that an unscrupulous sender did not forge the authentication information.

In another alternative applicable to any of the embodiments, Wi-Fi enabled wireless systems are utilized and the external processor comprises a Wi-Fi capable hand-held pocket PC such as the Toshiba e740 Pocket PC. Furthermore, differing types of processors and logic systems may be supported. For example, JAVA based PALM OS devices may be utilized. The message logic, processing logic, security logic, user interface logic, communications logic and other logic could be provided in JAVA format or in a format compatible with individual platforms such as Windows CE and PALM OS platforms. Similarly, other portable computing devices such as laptop computers and tablet computers and wireless capable computers could be utilized. Other platforms such as those using Symbian OS or OS-9 based portable processors could be utilized.

In another alternative applicable to any of the embodiments, authentication procedures utilize a token controller having a secure token key storage such as an iButton® available from Dallas Semiconductor in which an attack, for example, a physical attack on the device, results in an erasure of the key information. Passwords may be used, such as a password to access the device. In an alternative, the password may include biometric data read from a user. Alternatively, other secret key or public key systems may be utilized. Many key exchange mechanisms could be utilized included a Key Encryption Key. Additionally, authentication and repudiation systems such as a secure hash including SHA-1 could be utilized and encryption utilizing a private key for decryption by public key for authentication.

Known systems such as C++or Word and VBA may be utilized to implement the processes described. The ANOTO toolkits may also be utilized. Authentication data may be used to ensure that only authorized users have access to the postage meters 50. Other systems, processes and postage evidencing methods may be utilized, such as those described in the patent applications incorporated by reference above.

The present application describes illustrative embodiments of a system and method for dispensing value. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

The invention claimed is:

1. A method for dispensing postage value in a value dispensing system comprising:

obtaining a previously used uniquely identified reusable indicia that is deactivated and that includes a digital pen pattern;

scanning the digital pen pattern on the uniquely identified reusable indicia using a scanner and a local processor operatively connected to the scanner;

obtaining an identifier assigned to the indicia using the scan of the digital pen pattern;

assigning a postage value amount to the indicia using the local processor;

and electronically sending information associated with the indicia including the postage value amount to a remote central billing server for enabling the indicia, then sending the indicia to a third party using a carrier as part of a use transaction associated with the postage value amount, wherein, the reusable indicia is then reused in the postage value dispensing system after the use transaction associated with the postage value amount is completed by deactivating the reusable indicia and then reactivating the reusable indicia and assigning a second postage value amount to the reusable indicia.

2. The method of claim 1 wherein:

the use associated with the value amount is evidence of payment of postage associated with a mailpiece.

3. The method of claim 1 further comprising:

receiving an indication of authentication after sending information associated with the indicia to a remote central billing server.

4. The method of claim 2 further comprising:

placing the indicia on the mailpiece; and placing the mailpiece in the mail stream.

5. The method of claim 3 further comprising:

receiving an indication that the value was used.

6. The method of claim 1 wherein:

the indicia includes at least two overlapping digital pen patterns printed using at least two inks.

7. The method of claim 1 wherein:

the indicia includes a 2D barcode having a redundant identifier and a digital signature.

8. The method of claim 2 wherein:

assigning the postage value amount to the indicia is performed using a local postage vault.

9. A method for dispensing postage used in a postal carrier system comprising:

scanning a digital pen pattern including a uniquely identified indicia using a scanner and a local processor operatively connected to the scanner;

assigning a postage value to the indicia using the local processor and debiting a local postage vault in the amount of the postage value;

and electronically sending information associated with the indicia including the postage value to a remote central billing server for enabling the indicia, wherein, the indicia is reusable in the postal carrier system, by assigning a second postal value to the indicia, after the postal value has been used.

10. A method for processing a uniquely identified reusable indicia postage stamp that includes a digital pen pattern in a postal carrier system comprising:

initially configuring the uniquely identified reusable indicia postaqe stamp to be deactivated, wherein the uniquely identified reusable indicia is associated with an identifier;

electronically receiving information from a user, wherein the user scans the digital pen pattern to obtain the identifier from the uniquely identified reusable indicia postage stamp using a scanner and a local processor operatively connected to the scanner, wherein the information is received at a central billing server remote from the server, and wherein the information includes the identifier and a postage value for a postage transaction;

determining that the user may assign the postage value to the reusable indicia;

activating the reusable indicia with the postal value;

then, determining that the reusable indicia has been used in the postal carrier system, then, deactivating the reusable indicia; and then, reactivating the reusable indicia for a later postage transaction.

11. The method of claim 10, wherein:

reactivating the reusable indicia for a later postage transaction includes reactivating the reusable indicia with a second postage value.

12. The method of claim 10, wherein:

the reusable indicia includes at least two overlapping digital pen patterns printed using at least two inks.

13. The method of claim 10 wherein:

the reusable indicia includes a 2D barcode having a redundant identifier and a digital signature.

* * * * *